US006060440A

United States Patent [19]

Sackariasen et al.

[11] Patent Number: 6,060,440

[45] Date of Patent: May 9, 2000

[54] HOMOGENOUS SOLUTION OF AN ALPHA OLEFIN SULFONATE SURFACTANT

[75] Inventors: Kurt Sackariasen, Sea Girt; Robert Heffner, Somerset; Alp Uray, Mountainside; Robert D'Ambrogio, Bound Brook, all of N.J.

[73] Assignee: Colgate-Palmolive Co., Piscataway, N.J.

[21] Appl. No.: 09/415,752

[22] Filed: Oct. 12, 1999

[51] Int. Cl.[7] ..... C11D 17/00; C11D 17/08

[52] U.S. Cl. ..... 510/235; 510/237; 510/426; 510/428; 510/432; 510/470; 510/503

[58] Field of Search ..... 510/235, 237, 510/426, 427, 428, 432, 470, 503

[56] References Cited

U.S. PATENT DOCUMENTS

| | | | |
|---|---|---|---|
| 5,387,375 | 2/1995 | Erilli et al. | 252/546 |
| 5,998,347 | 12/1999 | D'Ambrogio et al. | 510/235 |

*Primary Examiner*—Necholus Ogden
*Attorney, Agent, or Firm*—Richard E. Nanfeldt

[57] ABSTRACT

The present invention relates to a homogenous, flowable solution of an alpha olefin sulfonate, ethanol and water which can be used in the formulation of cleaning compositions.

1 Claim, No Drawings

HOMOGENOUS SOLUTION OF AN ALPHA OLEFIN SULFONATE SURFACTANT

FIELD OF THE INVENTION

The present invention relates to a homogenous, flowable solution of an alpha olefin sulfonate, ethanol and water which can be used in the formulation of cleaning compositions.

BACKGROUND OF THE INVENTION

Several U.S. Patents disclose examples of olefin sulfonate in surfactant mixtures both with and without various salts and solvents as a means of reducing viscosity. However, none of these patents teach an example of only olefin sulfonate, water and ethanol added as a viscosity reducer. These U.S. Pat. Nos. are: 5,629,279; 5,529,722; 5,425,806; 5,415,813; 5,399,285; 5,284,603; 5,273,682; 5,000,262; 4,139,498 and 3,870,660.

SUMMARY OF THE INVENTION

The present invention relates to homogenous, flowable, and pumpable 55% alpha olefin sulfonate (AOS) solution which is prepared from a 73% $C_8$–$C_{18}$ alpha olefin sulfonate (AOS) mixture which utilize ethanol and water as a means of dilution. The invention teaches that after the addition of alcohol to the 73% AOS mixture only a narrow range of additional water to this system provides a useful, flowable material. This is unexpected since the initial system has more than 20% water. The formation of a homogenous, flowable and pumpable solution requires 18% alcohol and a narrow range of water added. If one adds too much water it causes the system to become too viscous and foamy and unusable.

DETAILED DESCRIPTION OF THE INVENTION

The present invention relates to a pumpable and flowable solution of a $C_8$–$C_{18}$ alpha olefin sulfonate which comprises approximately by weight:

(a) 5% to 60% of the $C_8$–$C_{18}$ alpha olefin sulfonate;

(b) 10% to 20% of ethanol; and (c) the balance being water, wherein said solution has a Brookfield viscosity at 25° C. using a #4 spindle at 20 rpms of about 3,000 to about 12,000 cps.

The solution of the $C_8$–$C_{18}$ alpha olefin sulfonate can be used to form a highly concentrated light duty liquid composition which comprises approximately by weight:

(a) 1% to 30% of a solution of 50 wt. % to 60 wt. % of a $C_8$–$C_{18}$ alpha olefin sulfonate, 10 wt. % to 20 wt. % of ethanol and 27 wt. % to 42 wt. % of water;

(b) 3% to 30% of at least one second surfactant selected from the group consisting of sulfate surfactants, carboxylate surfactants, ethoxylated nonionic surfactants, alkyl linear benzene sulfonate surfactants, paraffin sulfonate surfactants, glucamide surfactants, alkyl polyglucoside surfactants, zwitterionic surfactants, and amine oxides surfactants;

(c) 0 to 15%, more preferably 0.1% to 10% of at least one solubilizing agent; and (d) the balance being water.

A preferred light duty liquid cleaning composition comprises approximately by weight:

(a) 2% to 10%, more preferably 3% to 9% of a sodium salt of a $C_8$–$C_{16}$ paraffin sulfonate surfactant;

(b) 0 to 12%, more preferably 3% to 9% of a magnesium salt of a $C_8$–$C_{18}$ linear alkyl benzene sulfonate surfactant;

(c) 0 to 8%, more preferably 3% to 8% of a sodium salt of a $C_8$–$C_{18}$ linear alkyl benzene sulfonate surfactant;

(d) 0 to 15%, more preferably 7% to 14% of an ammonium or alkali metal salt of a $C_8$–$C_{18}$ ethoxylated alkyl ether sulfate surfactant;

(e) 5% to 15%, more preferably 8% to 13% of an alkyl polyglucoside surfactant;

(f) 0 to 3%, more preferably 0.1% to 24% of a $C_{14}$–$C_{18}$ fatty acid mono alkanol amide;

(g) 0 to 2%, more preferably 0.1% to 1.6% of sodium xylene sulfonate;

(h) 0 to 10%, more preferably 2% to 8% of an amine oxide surfactant;

(i) 0 to 2%, more preferably 0.1% to 1.5% of sodium chloride;

(j) 1% to 30% of a solution of 50 wt. % to 60 wt. % of a $C_8$ to $C_{18}$ alpha olefin sulfonate, 10 wt. % to 20 wt. % of ethanol and 27 wt. % to 42 wt. % of water; and (k) the balance being water.

The alpha olefin sulfonate solution of 50% to 60% of a $C_8$–$C_{18}$ alpha olefin sulfonate surfactant is prepared by adding to a 70% alpha olefin sulfonate (AOS) solution (100 grams, 70% by wt. AOS/30% by wt. water), ethanol (23 grams, 18% by wt. of final solution) which is slowly stirred until a homogenous paste is made. To this paste is slowly added water (4.3 grams, 27% by wt. total water in final solution) while stirring at a slow rate forming a homogenous, flowable, and pumpable 55% AOS solution. The amount of water added is critical, since too much will increase the viscosity sharply. One must add just enough water to form a 50% to 60% AOS at which point one runs the risk of increasing the viscosity significantly and the mixture is not flowable and hence unusable.

The solution of the 50 wt. % to 60% of the $C_8$–$C_{18}$ alpha olefin sulfonate surfactant is mixed by simply mixing techniques at 25° C. with additional surfactant and optionally solubilizing agents to form the liquid duty liquid cleaning compositions.

The alpha olefin sulfonates, includes long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of 8–15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The alkyl sulfate surfactants which can be used in the instant compositions are ammonium, alkali metal or alkaline earth metal salts of $C_8$–$C_{12}$ alkyl sulfates such as lauryl sulfate or myristyl sulfate. Ammonium lauryl sulfate is preferred. The $C_{8-18}$ ethoxylated alkyl ether sulfate surfactants which can be used in the instant composition have the structure $$R-(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an ammonium cation, alkali metal or an alkaline earth metal cation, most preferably magnesium, sodium or ammonium. The ethoxylated alkyl ether sulfate is generally present in the composition at a concentration of about 0 to about 20 wt. %, more preferably about 0.5 wt. % to 15 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The ammonium, alkali metal or alkaline earth metal salt of the sulfonate surfactant used in the instant compositions are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

One of preferred sulfonates is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The paraffin sulfonates which can be used in the instant composition contain about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

The zwitterionic surfactant used in the instant composition is a water soluble betaine having the general formula:

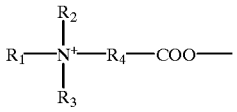

wherein $R_1$ is an alkyl group having 10 to 20 carbon atoms, preferably 12 to 16 carbon atoms, or the amido radical:

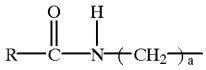

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hyroxyalkylene group having from 1 to 4 carbon atoms and, optionally, one hydroxyl group. Typical alkyldimethyl betaines include decyl dimethyl betaine or 2-(N-decyl-N,N-dimenthyl-ammonia) acetate, coco dimethyl betaine or 2-(N-coco N,N-dimethylammonio)acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

Amine oxide semi-polar nonionic surfactants comprise compounds and mixtures of compounds having the formula

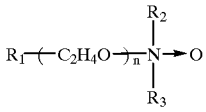

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

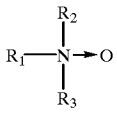

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

The instant composition can contain a mixture of a $C_{12-14}$ alkyl monoalkanol amide such as lauryl monoalkanol amide and a $C_{12-14}$ alkyl dialkanol amide such as lauryl diethanol amide or coco diethanol amide.

The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization) =1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Sodium bisulfite can be used as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as ethanol, sodium chloride and/or sodium cumene or sodium xylene sulfonate are used to assist in solubilizing the surfactants. The viscosity of the light duty liquid composition desirably will be at least 100 centipoises (cps) at room temperature, but may be up to 1,000 centipoises as measured with a Brookfield Viscometer using a number 3 spindle rotating at 12 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is substantially neutral to skin, e.g., 4.5 to 8 and preferably 5.0 to 7.0. The pH of the composition can be adjusted by the addition of $Na_2O$ (caustic soda) to the composition.

The instant compositions have a minimum foam volume of 350 mis after 40 rotation at 25° C. as measured by the foam volume test using 0.033 wt. % of the composition in 150 ppm of water. The foam test is an inverted cylinder test in which 100 ml. of a 0.033 wt. % LDL formula in 150 ppm of $H_2O$ is placed in a stoppered graduate cylinder (500 ml) and inverted 40 cycles at a rate of 30 cycles/minute. After 40 inversions, the foam volume which has been generated is measured in mis inside the graduated cylinder. This value includes the 100 ml of LDL solution inside the cylinder.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

Procedure for the Preparation of 55% AOS

To a 70% alpha olefin sulfonate (AOS) solution (100 grams, 70% by wt. AOS/30% by wt. water) is added ethanol (23 grams, 18% by wt. of final solution) which is slowly stirred until a homogenous paste is made. To this paste is slowly added water (4.3 grams, 27% by wt. total water in final solution) while stirring at a slow rate forming a homogenous, flowable, and pumpable 55% AOS solution. The Brookfield viscosity of the alpha olefin sulfonate solution at 25° C., #4 spindle at 20 rpms will be in a range from 3,000 cps to 12,000 cps. The viscosity will also be affected by the final ethanol content. The sample from Chemithon contains approximately 18% ethanol and has a viscosity of 4,000 cps at 25° C. at 20 rpm with a spindle 4 on a Brookfield viscometer.

EXAMPLE 2

The following formulas were prepared at room temperature by simple liquid mixing procedures as previously described.

| | A | B | C | D | E | F |
|---|---|---|---|---|---|---|
| MgLAS | 6.13 | | 6.33 | 4.90 | | 6.33 |
| NaLAS | 6.13 | 6.33 | | | 6.33 | |
| Paraffin sulfonate | | 6.33 | 6.33 | 5.00 | 6.33 | 6.33 |
| NH4 AEOS 1.3EO | 19.14 | 9.87 | 9.87 | | 9.87 | 8.50 |
| AOS C14/C16 55% AOS (17.1% ethanol) solution of Example 1 | | 9.87 | 9.87 | 15.00 | 9.87 | 11.24 |
| APG625 HSF40-677 | 12.26 | 9 | 9 | 10.00 | 9.00 | 9.00 |
| LMMENSXS 5:3 ratio | 2.17 | 2 | 2 | | 2.50 | 2.50 |
| CAP amine oxide | | | | 6.38 | | |
| Water | Bal. | Bal. | Bal. | Bal. | Water | Water |
| Shell (gms soil added) | 5.41 | 5.01 | 5.18 | 6.34 | 5.25 | 5.58 |
| Shell score vs. Control (%) | 100 (control) | 93 | 96 | 117 | 97 | 103 |
| Miniplate (# plates) | 31.3 | 30.5 | 29.8 | 27.7 | 34.0 | 33.3 |
| Miniplate score vs. Control (%) | 100 (control) | 97 | 95 | 88 | 109 | 106 |
| Shake foam init. (vol. In ml) | 415 | 402 | 398 | 393 | 403 | 402 |
| SF soil vs. Control (%) | 100 (control) | 95 | 94 | 92 | 95 | 95 |
| Shake foam with milk soil (vol. In ml) | 223 | 220 | 215 | 157 | 215 | 207 |
| SF soil vs. Control (%) | 100 (control | 99 | 96 | 70 | 96 | 93 |
| Baumgartner (% lard removed) | 29.0 | 38.4 | 39.5 | 28.5 | 39.2 | 40.1 |
| Baumgartner vs. Control (%) | 100 (control) | 132 | 135 | 98 | 135 | 138 |
| Cup (% tallow removed) | 5.1 | 6.3 | 7.6 | 16.8 | 7.2 | 6.5 |
| Cup vs. Control (%) | 100 (control) | 124 | 149 | 329 | 141 | 127 |

What is claimed is:

1. A light duty liquid cleaning composition comprises approximately by weight:

(a) 3% to 9% of a sodium salt of a $C_8$–$C_{16}$ paraffin sulfonate surfactant;

(b) 3% to 9% of a magnesium salt of a $C_8$–$C_{18}$ linear alkyl benzene sulfonate surfactant;

(c) 3 to 8% of a sodium salt of a $C_8$–$C_{18}$ linear alkyl benzene sulfonate surfactant;

(d) 7% to 14% of an ammonium or alkali metal salt of a $C_8$–$C_{18}$ ethoxylated alkyl ether sulfate surfactant;

(e) 5% to 15% of an alkyl polyglucoside surfactant;

(f) 0.1 to 3% of a $C_{14}$–$C_{18}$ fatty acid mono alkanol amide;

(g) 0.1% to 1.6% of sodium xylene sulfonate;

(h) 2% to 8% of an amine oxide surfactant;

(i) 0.1% to 1.5% of sodium chloride;

(j) 1 to 30% of a solution of 50 wt. % to 60 wt. % of a $C_8$ to $C_{18}$ alpha olefin sulfonate, 10 wt. % to 20 wt. % of ethanol, and 27 wt. % to 42 wt. % of water; and (k) the balance being water.

* * * * *